US011486194B2

(12) United States Patent
Thomsen

(10) Patent No.: US 11,486,194 B2
(45) Date of Patent: Nov. 1, 2022

(54) SCREENING ARRANGEMENT WITH IMPROVED MOUNTING BRACKET AND END PIECE, WINDOW WITH SUCH A MOUNTING BRACKET AND METHOD OF INSTALLING AND UNINSTALLING A SCREENING ARRANGEMENT IN THE WINDOW

(71) Applicant: VKR Holding A/S, Hørsholm (DK)

(72) Inventor: Peder Solsø Thomsen, Skjern (DK)

(73) Assignee: VKR Holding A/S

( * ) Notice: Subject to any disclaimer, the term of this patent is extended or adjusted under 35 U.S.C. 154(b) by 1028 days.

(21) Appl. No.: 16/185,614

(22) Filed: Nov. 9, 2018

(65) Prior Publication Data

US 2019/0145163 A1 May 16, 2019

(30) Foreign Application Priority Data

Nov. 10, 2017 (DK) ..... PA 2017 70846

(51) Int. Cl.
*E06B 9/42* (2006.01)
*E06B 9/323* (2006.01)
(Continued)

(52) U.S. Cl.
CPC ..... *E06B 9/42* (2013.01); *E06B 9/174* (2013.01); *E06B 9/323* (2013.01); *E06B 9/50* (2013.01)

(58) Field of Classification Search
CPC ..... E06B 9/42; E06B 9/266; E06B 2009/015; E06B 9/1703; E06B 9/323; E06B 9/174;
(Continued)

(56) References Cited

U.S. PATENT DOCUMENTS 4,114,860 A * 9/1978 Parisien ..... E04H 17/1417 256/65.04
7,267,311 B2 * 9/2007 Jung ..... E06B 9/50 160/903
(Continued)

FOREIGN PATENT DOCUMENTS

DE 19861119 2/2000
EP 1106775 6/2001
(Continued)

OTHER PUBLICATIONS

1st Technical Examination including Search Report and Search Opinion dated May 9, 2018 issued in connection with Danish Patent Application No. 2017 70846, pp. 1 to 8.
(Continued)

*Primary Examiner* — Johnnie A. Shablack
*Assistant Examiner* — Matthew R. Shepherd
(74) *Attorney, Agent, or Firm* — Merek, Blackmon & Voorhees, LLC

(57) ABSTRACT

The screening device (12) is provided with a set of two end pieces (171), each having a generally plane body portion (1710) extending substantially in a plane, and a set of two mounting brackets (50). During mounting, the screening device (12) is configured to be connected with the set of mounting brackets (50) by moving the screening device with its set of end pieces (161, 171) substantially in the depth direction (X). Locking means includes a tab (40) of the end piece (171) to interact with a notch (52) and a resilient tab (30) provided at the periphery of the end piece (171) and biased in the height direction (Z). In an embodiment, the resilient tab (30) is configured to interact with a notch (51) on the mounting bracket (50).

31 Claims, 11 Drawing Sheets

(51) Int. Cl.
*E06B 9/174* (2006.01)
*E06B 9/50* (2006.01)

(58) Field of Classification Search
CPC ..... E06B 9/50; E06B 9/56; E06B 2009/527; E06B 9/54; A47H 1/13; A47H 1/14; A47H 1/142; A47H 1/144; F16M 13/02
USPC .. 248/200, 205.1, 208, 561, 220.21, 220.22, 248/222.11, 222.12
See application file for complete search history.

(56) References Cited

U.S. PATENT DOCUMENTS

| | | | | |
|---|---|---|---|---|
| 7,367,536 | B1 * | 5/2008 | Anderson | A47H 1/144 248/251 |
| 7,913,960 | B1 * | 3/2011 | Herr, III | E04F 11/1834 248/205.1 |
| 2007/0144682 | A1 * | 6/2007 | Drew | E06B 9/323 160/23.1 |
| 2008/0128164 | A1 * | 6/2008 | Johnson | H02G 3/0691 174/660 |
| 2016/0160492 | A1 * | 6/2016 | Gower | E04B 1/40 52/202 |
| 2017/0211326 | A1 | 7/2017 | Mugnier | |
| 2017/0226797 | A1 * | 8/2017 | Birkkjaer | E06B 9/52 |
| 2018/0112462 | A1 * | 4/2018 | Chen | E06B 9/50 |

FOREIGN PATENT DOCUMENTS

| | | |
|---|---|---|
| EP | 2754843 | 7/2014 |
| EP | 3091168 | 9/2016 |
| EP | 3121364 | 1/2017 |
| EP | 3205808 | 8/2017 |
| EP | 3219898 | 9/2017 |
| WO | WO9907974 | 2/1999 |
| WO | WO0047858 | 8/2000 |
| WO | WO2004070157 | 8/2004 |
| WO | WO2005008013 | 1/2005 |
| WO | WO2006048014 | 5/2006 |
| WO | WO2007110072 | 10/2007 |
| WO | WO2015028031 | 3/2015 |
| WO | WO2017089863 | 6/2017 |

OTHER PUBLICATIONS

U.S. Appl. No. 16/186,130, filed Nov. 9, 2018 entitled "A Method for Determining a Fully Extended Position of a Screening Body of a Screening Device".

* cited by examiner

SCREENING ARRANGEMENT WITH IMPROVED MOUNTING BRACKET AND END PIECE, WINDOW WITH SUCH A MOUNTING BRACKET AND METHOD OF INSTALLING AND UNINSTALLING A SCREENING ARRANGEMENT IN THE WINDOW

CROSS-REFERENCE TO RELATED APPLICATION

The present application claims the priority under 35 U.S.C. 119 of Danish Application No. PA 2017 70846, filed on Nov. 10, 2017, which is hereby incorporated herein by reference in its entirety.

TECHNICAL FIELD

The present invention relates to a screening arrangement comprising a screening device with a set of end pieces and a set of mounting brackets, with locking means including at least one set of locking means. The invention furthermore relates to a window having a frame and a set of mounting brackets mounted to the frame, and a method of installing and uninstalling such a screening arrangement in a window.

BACKGROUND ART

Screening arrangements of this kind are either provided in a supply condition, or pre-installed from the factory. Either way, the mounting of the screening arrangement in the window frame must be able to be carried out without too many difficulties and with a low risk of erroneous installation. The window frame may be either a stationary frame or sash, or an openable sash, Likewise, dismounting of the screening arrangement should also be possible without the risk of breaking or otherwise damaging either the screening arrangement of the window in which it is installed Support assemblies including mounting brackets and end pieces are described in Applicant's published international applications and counterpart European patents Nos WO 99/07974 A1 (EP 1003953 B1) and WO 00/47858 A1 (EP 1151176 B1).

In support assemblies of the kind mentioned in the above, relatively safe temporary retention of the screening arrangement by means of the support assembly is vital to facilitate the installation. For instance, in WO 00/47858 A1, a squeezing, clamping or springy action is provided to ensure temporary retention by obtaining a close contact between the coupling member and the mounting bracket.

However, there is an increased focus on providing a stable engagement without compromising the possibility to dismount the screening arrangement, either in its entirety, or in order to maintain or replace the screening device or parts thereof. This is growing even more important as window tend to have larger dimensions, and the unavoidable production tolerances are thus increasing as well, rendering in turn the mounting and dismounting even more difficult.

Examples of prior art arrangements are found in WO 2004/070157 A1 and EP 1 106 775 A1, which devise well-functioning devices, but are in practice limited to specific types of screening only.

Eventually, Applicant's published international applications and counterpart European patents or patent applications Nos WO 2005/008013 A1 (EP 1857630); WO 2006/048014 A1 (EP1807598B1); and WO 2007/110072 A1 (EP2002079). Even though these solutions have proven to function well over the years, there is an ever-increasing need for even more flexible and facilitated installation and dismounting of the screening arrangement which is furthermore applicable to a wide variety of screening types.

SUMMARY OF INVENTION

It is therefore the object of the invention to provide facilitated installation and dismounting conditions while at the same time retaining the stable engagement in the position of use of the screening arrangement.

In a first aspect, this and further objects are met by a screening arrangement mentioned in the introduction, which is furthermore characterised in that a first set of locking means comprises a tab having a height dimension in the height direction provided on the end piece and configured to interact with a notch of the mounting bracket, that a resilient tab is provided at the periphery of the end piece and biased in the height direction to prevent the tab from being removed from the notch in the mounted condition, and in that the mounting bracket and the end piece are configured to allow the end piece to be positioned in a removal position relative to the mounting bracket by moving the top element of the screening device in the height direction, thereby pushing the resilient tab against its bias and subsequently allowing the tab to be disengaged from the notch by pulling the top element of the screening device substantially in the opposite of the mounting direction, thereby dismounting the screening device.

In this way, the screening device is safely retained on the mounting brackets during normal use, thus preventing unintentional release of the locking means. The resilient tab acts to keep the tab in the notch, either by the interaction between the end piece and the mounting bracket, or by pushing against an external surface such as a part of the frame and sash in which the screening arrangement is mounted. In this way, the cooperation between the tab and notch on one hand and the resilient tab on the other acts to provide a snap lock which is engaged in the mounted condition. In case the screening arrangement is to be dismounted, either to replace the screening device, or to remove the screening arrangement entirely, the user simply grabs the top element of the screening device, moves it in the height direction, against the bias of the resilient tab, such that the tab is withdrawn from the notch and pulls the screening device towards himself or herself, thus overcoming the locking function of the engagement between the tab and the notch. In other words, the snap lock is thus engaged until the user actively pulls the screening device, typically in the direction substantially perpendicularly away from the pane of the frame to be screened. This prevents any unintentional or untimely release of the screening device from the mounting brackets. During this procedure, there is no need for separate tools or to manipulate the locking means by hand.

In a presently preferred embodiment, the tab faces the resilient tab in the mounted condition and the resilient tab defines a height level in its relaxed condition, and the tab has a guiding surface located at a distance from the resilient tab in its relaxed condition and an abutment surface to interact with the notch of the mounting bracket, and wherein the mounting bracket includes a first ledge section protruding from the plane body portion and located at a first distance from an edge of the mounting bracket, said first distance being slightly smaller than the distance between the guiding surface of the tab and the resilient tab of the end piece in its relaxed condition, such that the set of locking means is able to be engaged in the mounted condition and be disengaged when the end piece is positioned in the removal position.

By incorporating a set of cooperating guides on the end pieces and the mounting brackets, respectively, the mounting and dismounting of the screening device from the mounting brackets and hence from the window is facilitated even further. The screening device with its end pieces is safely guided in the mounting direction until a distinct locking position occurs when the tab of the end pieces snaps into the notch of the respective mounting bracket by the action of the resilient tab. Conversely, when dismounting the screening arrangement, the user is able to withdraw the tab from the notch by moving the screening device in the height direction, against the bias of the resilient tab, due to the difference in distances, before pulling the screening device top element in the dismounting direction. Finally, the screening arrangement in this embodiment is independent of its position relative to the window in which it is mounted, and hence, slight deviations in the shape and size due to unavoidable tolerances of the window do not affect the functioning of the screening arrangement during mounting and dismounting.

The advantages of the first aspect of the invention and further developed embodiments are also applicable to the second and third aspects of the invention as have been described in the above and reference is made thereto.

Presently preferred embodiments are the subject of dependent claims.

Further details are described, and further advantages stated, in the description of particular embodiments of the invention.

BRIEF DESCRIPTION OF DRAWINGS

In the following description embodiments of the invention will be described with reference to the schematic drawings, in which.

DESCRIPTION OF EMBODIMENTS

Figure 1:
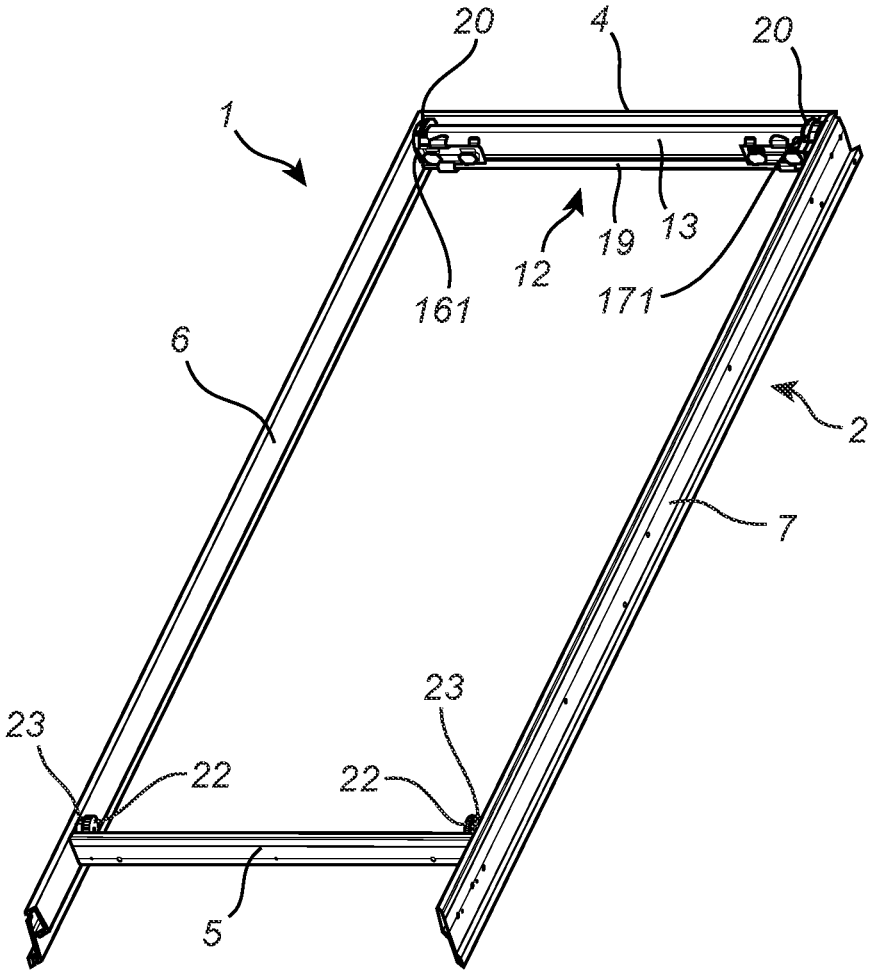
FIG. 1 is a perspective view of a roof window according to the second aspect of the invention comprising a screening device according to the first aspect of the invention.
Figure 2:
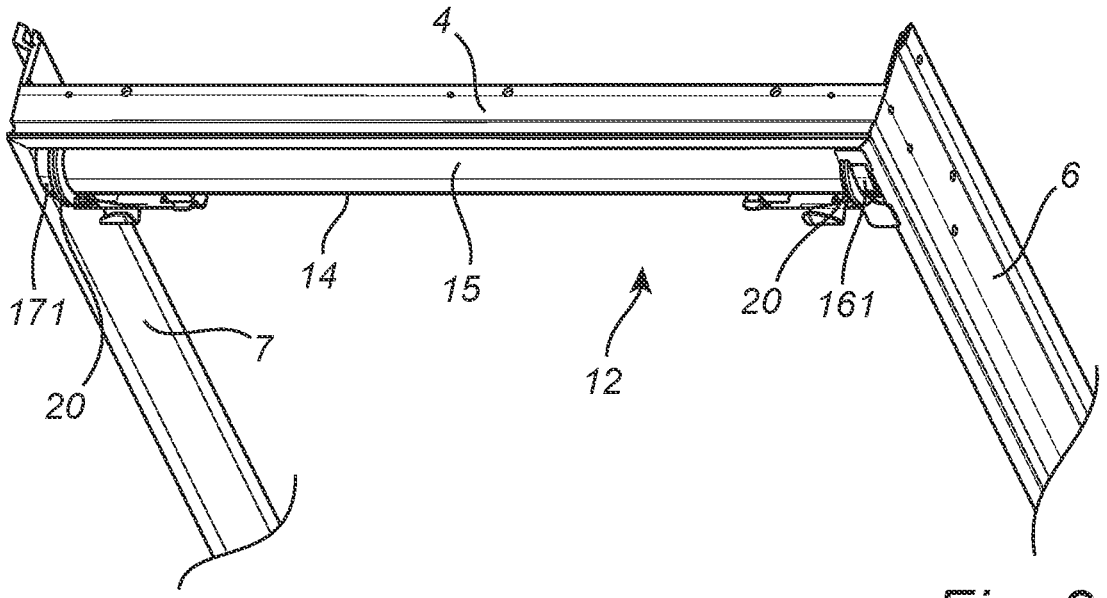
FIGS. 2 and 3 are close ups of the top element and screening device of FIG. 1 and comprising a roller tube, with and without the frame member being shown, respectively.

Referring initially to FIGS. 1 and 2, a first embodiment of a screening device 12 mounted in a roof window 1 is shown. The roof window 1 shown in FIG. 1 is adapted for mounting in an inclined roof. The roof window 1 comprises a frame 2 and an openable sash supporting a glass pane. For the sake of simplicity, the openable sash and the glass pane are omitted on FIG. 1. In the embodiment shown, the roof window is of the kind shown and described in for instance Applicant's WO 2015/028031 A1; however, the principle underlying the invention is applicable to all kinds of roof windows, in that the sash may be top hung, centre hung, have hinge axis at position between the top and centre or of the kind that is top hung during normal operation but which pivots for cleaning by means of an intermediate frame. The frame 2 comprises a top frame member 4, a bottom frame member 5 and two side frame members 6, 7. The sash comprises a top sash member, a bottom sash member and two side sash members.

The screening device 12 is in the embodiment shown is installed at the top frame member 4 of the roof window 1. The screening device 12 may in principle be any feasible type of screening device 12. In the embodiment shown the screening device is a roller blind. In another embodiment the screening device may be a roller shutter. It is noted that a screening device 12 according to the invention may also be mounted at other frame members of the roof window, or on a façade window or a door.

Figure 3:
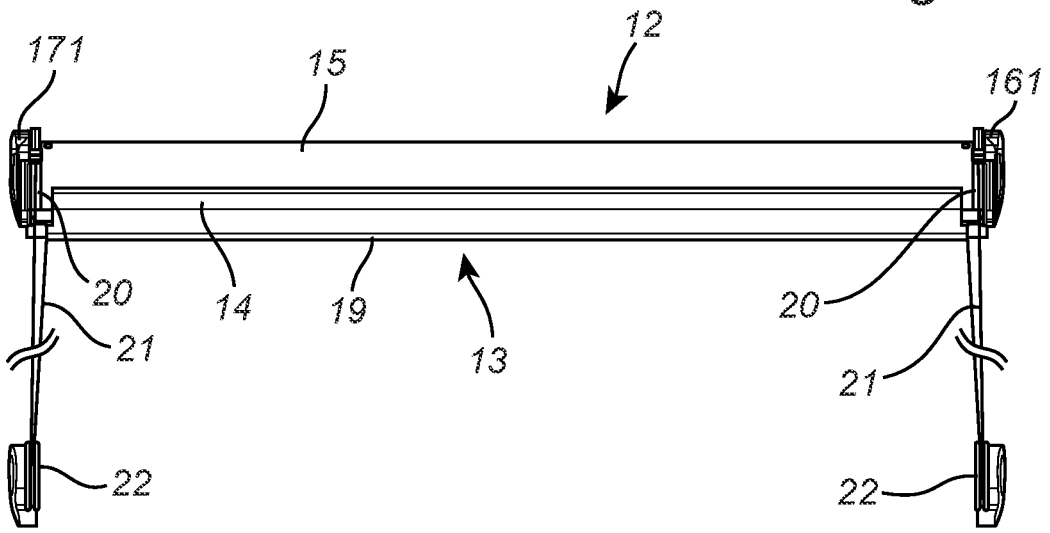
Figure 4:
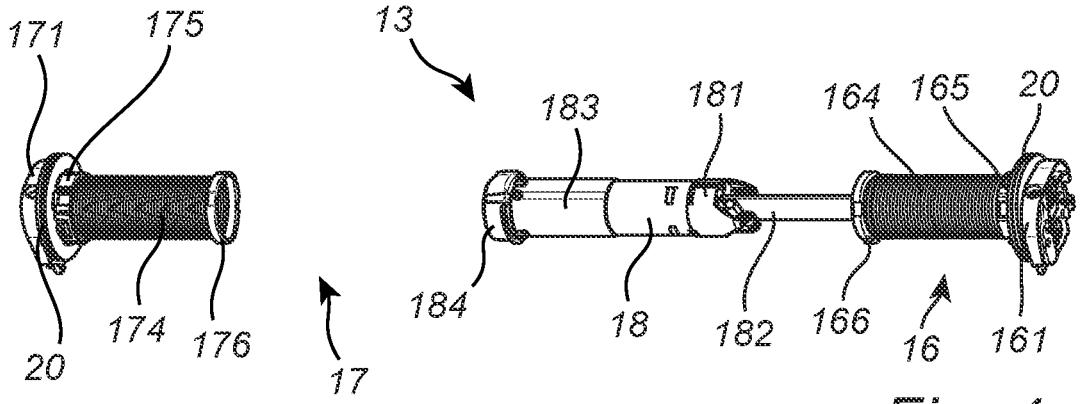
FIG. 4 is a partially exploded view of the top element of a screening device according to the first aspect of the invention, the roller tube and thus also the screening body being removed for the sake of simplicity.

Turning now also to FIGS. 3 and 4, an embodiment of a screening device 12 according to the invention will be described in more detail. The screening device 12 generally comprises a screening body 14 and a top element 13 with two end sections 16, 17. The screening device 12 is connected to the side frame members 6 and 7 at the end sections 16, 17 of the top element 13 by means of supporting means including a set of mounting brackets (not visible in FIGS. 1 and 2) fastened to the respective side frame member 6, 7 cooperating with end sections 16, 17 as will be described in further detail below. The set of mounting bracket may be fastened to the frame at the factory such that the roof window is prepared for subsequent mounting of the screening device, and possibly the screening device 12 may be pre-mounted at the factory as well. In a manner known per se the screening body 14 is wound on a roller tube indicated by reference numeral 15 in FIGS. 2 and 3, but in fact hidden behind the screening body 14. In FIG. 4, the roller tube 15 and thus also the screening body 14 has been removed for easy readability. In the embodiment shown, the screening device 12 further comprises a bottom bar 19 and two winding wheels 20. The winding wheels 20 are adapted for receiving a respective wire 21 (FIG. 3) which is wound onto the winding wheels 20 when pulling up the screening body 14 and out from the winding wheels 20 when pulling down the screening body 14. To this end the screening device 12 further comprises return pulleys 22 (FIG. 3) around which the wires 21 are lead and returned to the bottom bar 19.

As shown in FIG. 4 the screening device 12 further comprises a motor 18 accommodated in the top element 13, in the embodiment shown an electric motor, adapted for driving the screening device 12. To this end the motor 18 is connected to the winding wheels 20 via a suitable transmission such as to enable moving the screening body 14 between a fully retracted position, in which the screening body 14 does not cover the glass pane of the window, and is completely wound onto the roller tube 15, and a fully extended position, in which the screening body 14 covers substantially all of the glass pane of the window and is fully extended from the roller tube 15. The motor 18 comprises in the embodiment shown a tachometer 181, a printed circuit board 182 and a planetary gear 183. The motor 18 is connected to a rotatable cap 184, which in turn is connected to the roller tube 15 at an inner side of the roller tube 15 such that the motor 18 in operation may rotate the roller tube 15.

Figure 5:
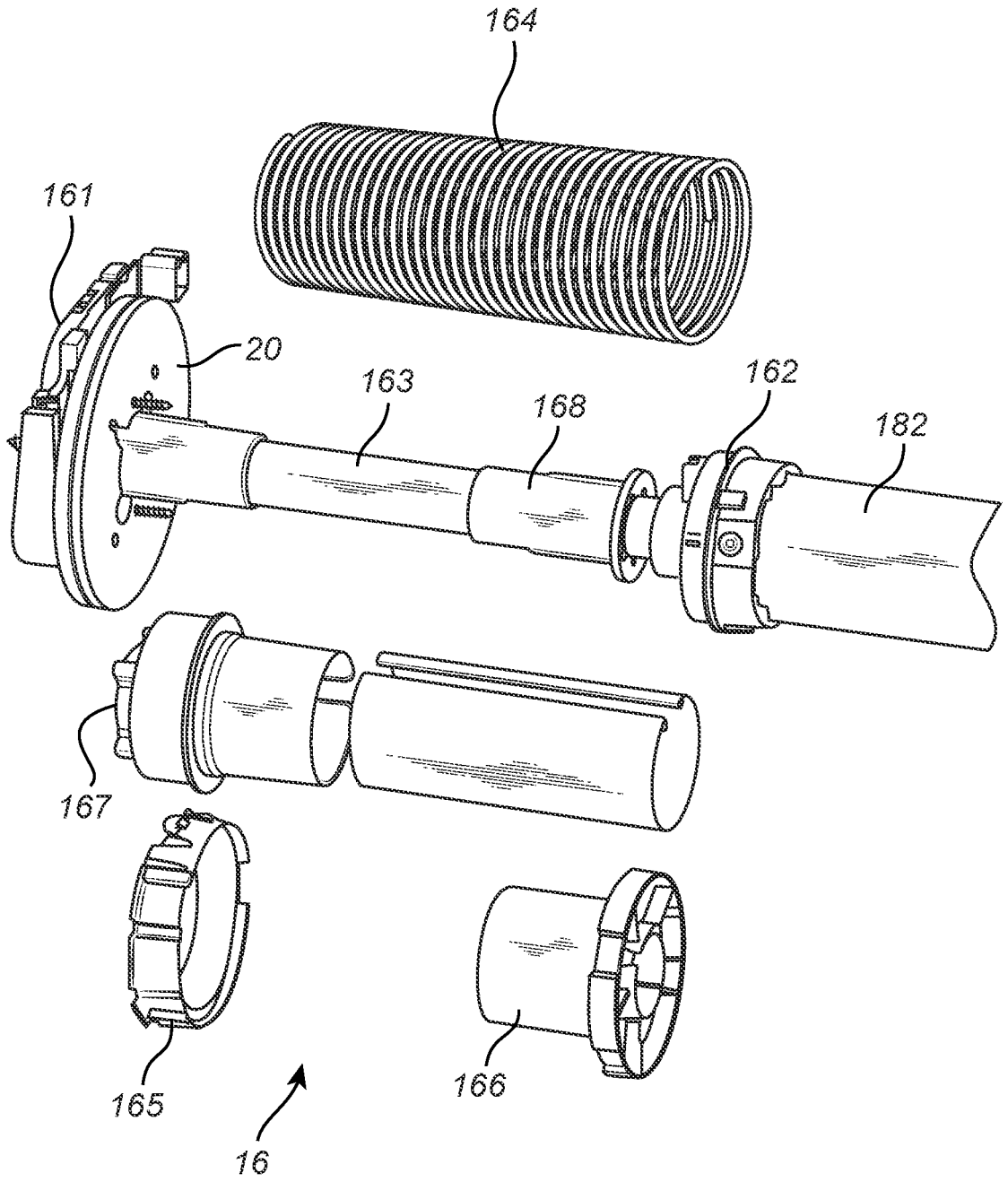
FIG. 5 is an exploded view of a first end section of a screening device according to the first aspect of the invention.
Figure 6:
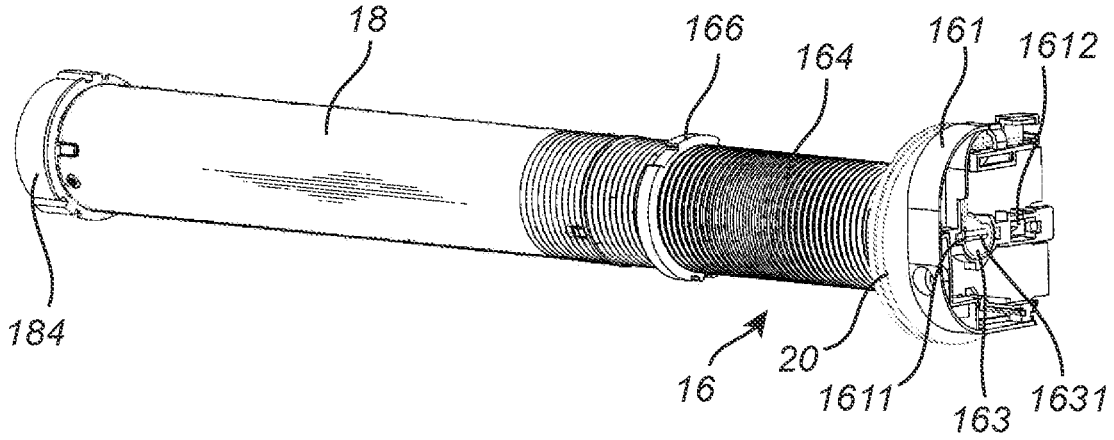
FIG. 6 is a perspective view of a first end section of the top element of a screening device according to the first aspect of the invention.
Figure 7:
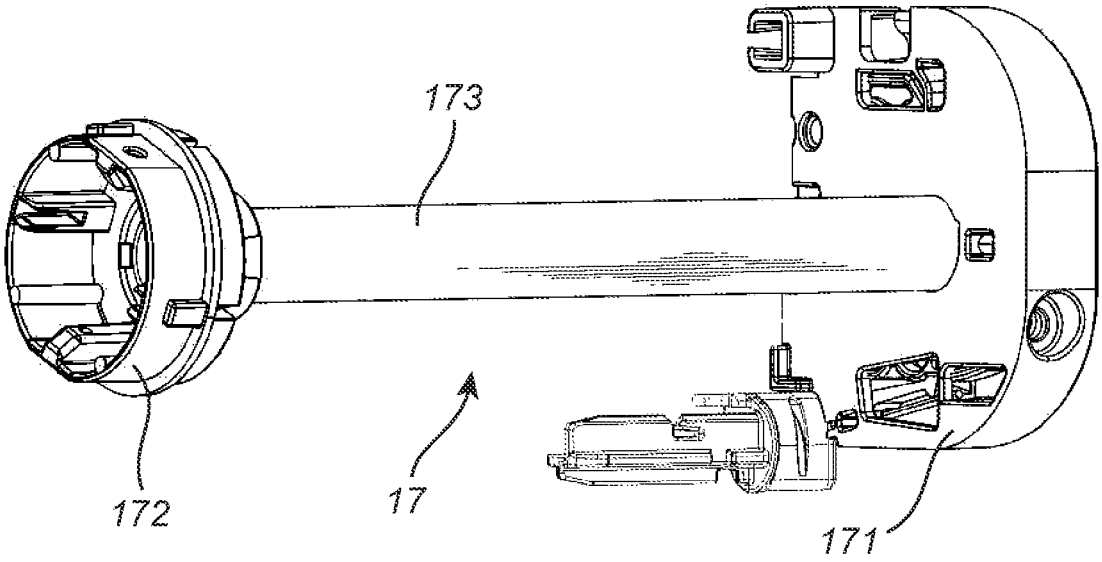
FIG. 7 is a perspective view of a second end section of the top element of a screening device according to the first aspect of the invention opposite to the first end section according to FIGS. 5 and 6.
Figure 8:
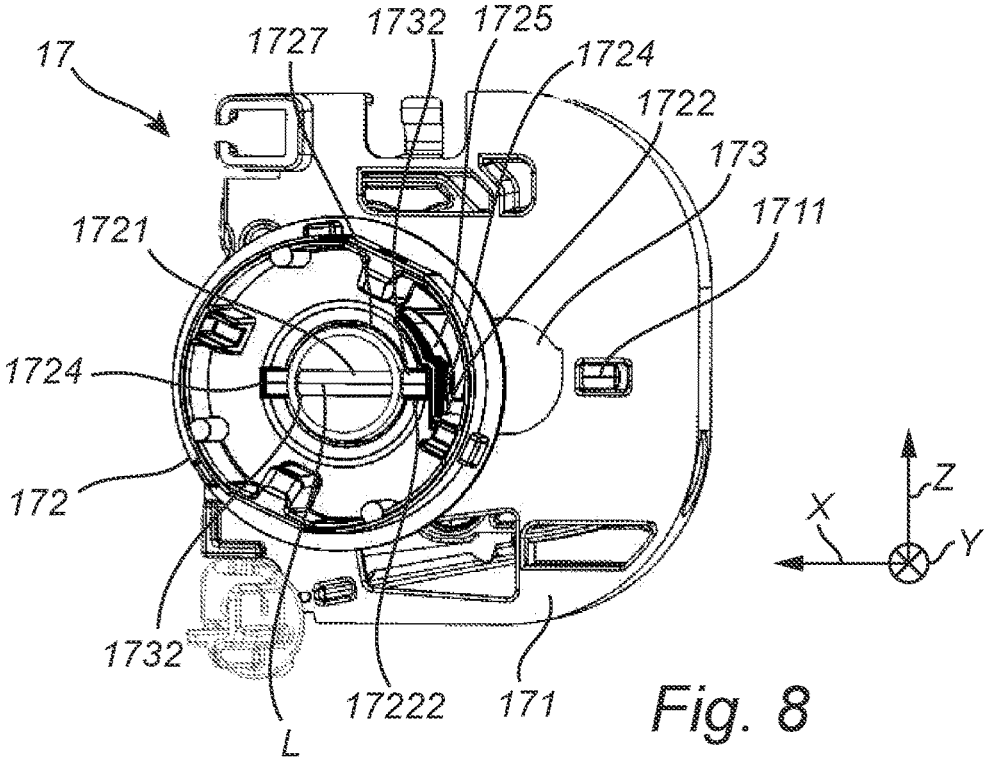
FIG. 8 is an end view of the end section according to FIG. 7.

Referring now also to FIGS. 5, 6 and 7, each end section 16 (FIGS. 5 and 6) and 17 (FIG. 7) generally comprises an end piece 161 and 171, respectively, an inner piece 162 and 172, respectively, and a rod element 163 and 173, respectively. The rod element 163 connects the end piece 161 and the inner piece 162 of the end section 16, and the rod element 173 connects the end piece 171 and the inner piece 172 of the end section 17. The end piece 161 and the inner piece 162 of the end section 16 are connected to opposite longitudinal ends of the rod element 163, and the end piece 171 and the inner piece 172 of the end section 17 are connected to opposite longitudinal ends of the rod element 173.

Referring to FIGS. 5 and 6, the end section 16 further comprises a spring element 164 having one end attached to a first rotatable holder 166 and the opposite end attached to a second rotatable holder 167 (FIG. 5), which in turn is attached fixedly to the winding wheel 20. A rotatable element 165 or ring is arranged on the second rotatable holder 167. The rotatable element 165 is freely rotatable with respect to the second rotatable holder 167. The rotatable element 165 is not attached to the spring element 164. The rotatable element 165 can thus rotate freely with respect to the spring element 164. The rotatable element 165 is in the assembled condition of the screening device 12 attached to the roller tube 15. The motor 18 is connected to the rotatable element 165, which in turn is connected to the roller tube 15 and the spring element 164 such that the motor 18 in operation may rotate the spring element 164. The spring element 164, the second rotatable holder 167 and the rotatable element 165 are arranged concentrically on the rod element 163 of the end section 16 between the end piece 161 and the inner piece 162. The first rotatable holder 166 is arranged concentrically on the rod element 163 of the end section 16, optionally on a seat or bearing 168, between the end piece 161 and the inner piece 162. Also, the winding wheel 20 is arranged concentrically with respect to the rod element 163 adjacent to the end piece 161. Furthermore, the rotatable holder 166 is in the assembled condition of the screening device 12 attached to an inner surface of the roller tube 15 The rotatable holder 166 can thus rotate with the roller tube 15.

Likewise, referring to FIGS. 4 and 7, the end section 17 further comprises a spring element 174 having one end attached to a first rotatable holder 176 and the opposite end attached to a second rotatable holder (not visible), which in turn is attached to the winding wheel 20. A rotatable element 175 or ring is arranged on the second rotatable holder. The rotatable element 175 is not attached to the spring element 174. The rotatable element 175 is in the assembled condition of the screening device 12 attached to the roller tube 15. The spring element 174, the first rotatable holder 176, the second rotatable holder and the rotatable element 175 are arranged concentrically on the rod element of the end section 17 between the end piece 171 and the inner piece. Also, the winding wheel 20 is arranged concentrically on the rod element adjacent to the end piece 171. Furthermore, the rotatable holder 176 is in the assembled condition of the screening device 12 attached to an inner surface of the roller tube 15.

Thus, the respective spring element 164, 174 and the respective winding wheel 20 may rotate together. The spring elements 164 and 174 are in an embodiment a helical spring. The spring elements 164 and 174 are always in an inherent pre-tensioned state.

One of the end sections 16 and 17, in the embodiment shown the end section 16, is furthermore connected to the motor 18. More particularly, the motor 18, in the embodiment shown (cf. FIG. 5) the printed circuit board 182 of the motor 18, is attached to the inner piece 162 of the end section 16 in a non-rotatable manner. Thereby, the inner piece 162, the printed circuit board 182 and the rod element 163 are connected in such a manner that they form one rigid element.

Generally, according to the invention, at least one, and optionally any two or three or all four, of the end piece 161 and the inner piece 162 of the first end section 16 and the end piece 171 and the inner piece 172 of the second end section is connected to the rod element 163 and 173, respectively, by means of a pin 1611, 1621, 1711, 1721, respectively, which pin is arranged extending through at least one opening in the rod element 163, 173, respectively, and attached to the at least one of the end pieces and the inner pieces.

Figure 9:
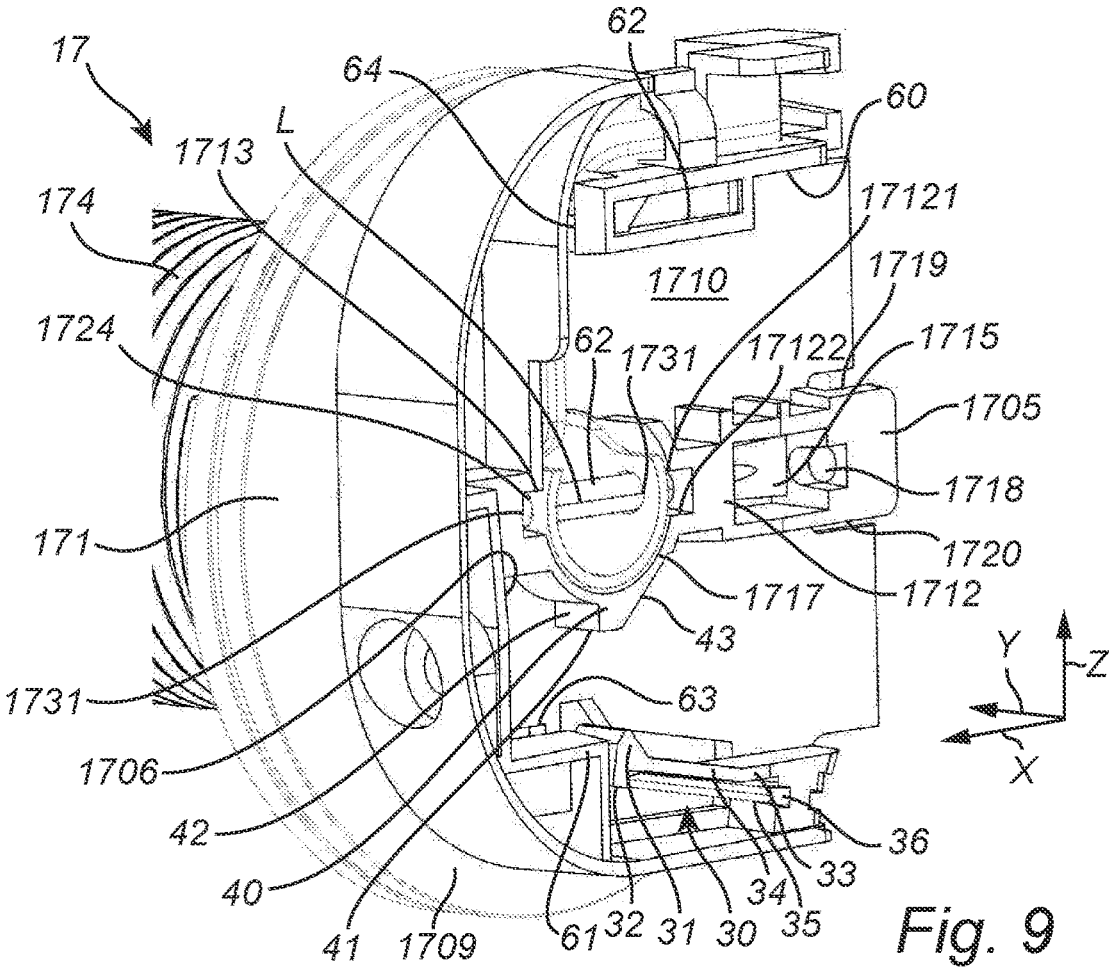
FIG. 9 is a perspective view of an end piece adapted for connection to a frame element of a window of an end section, the end piece being connected to a rod element by means of a pin.
Figure 10:
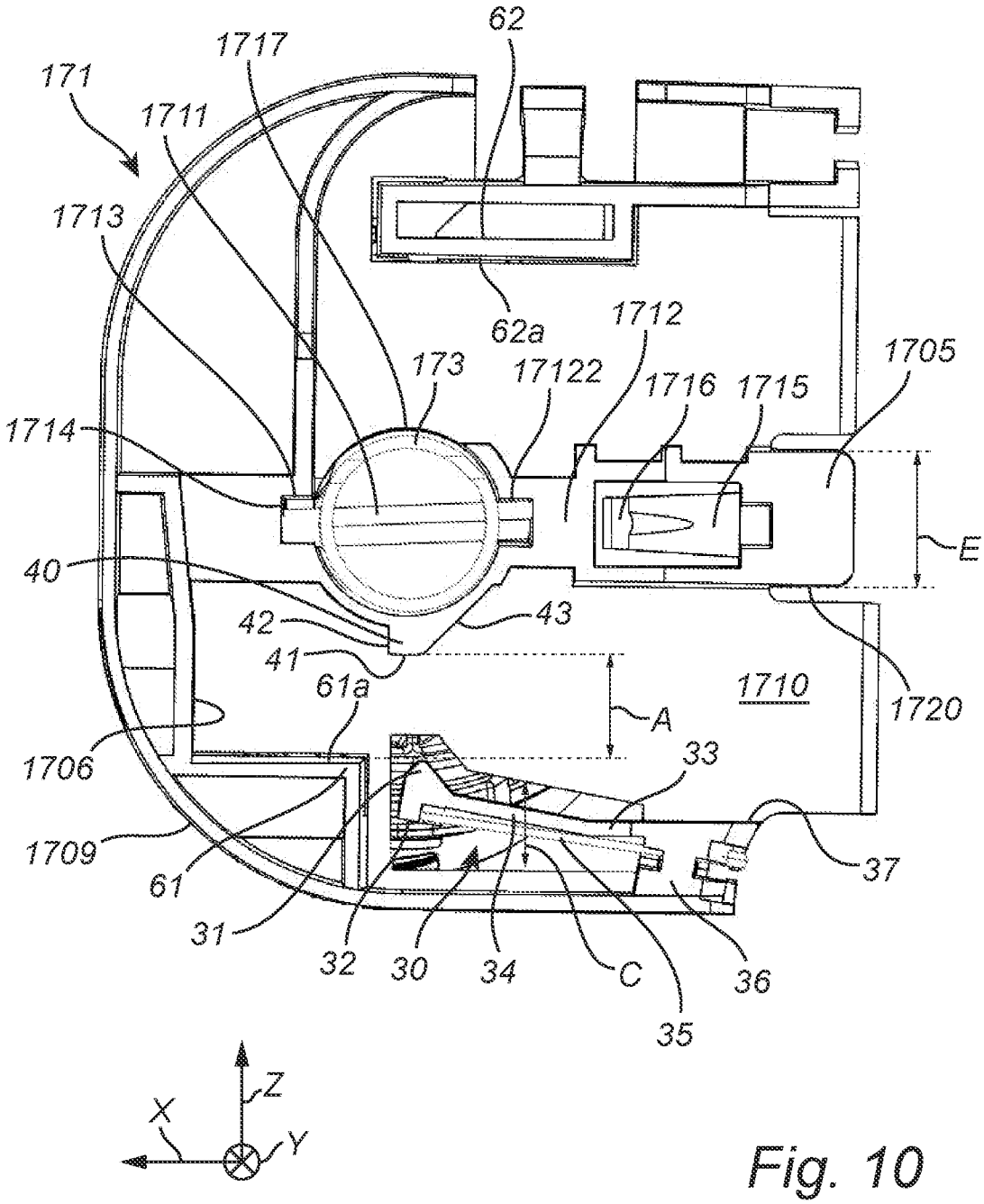
FIG. 10 is an end view of the end piece according to FIG. 9, FIGS. 11 and 12 are a top view and a bottom view, respectively, of a mounting bracket according to the invention.
Figure 11:
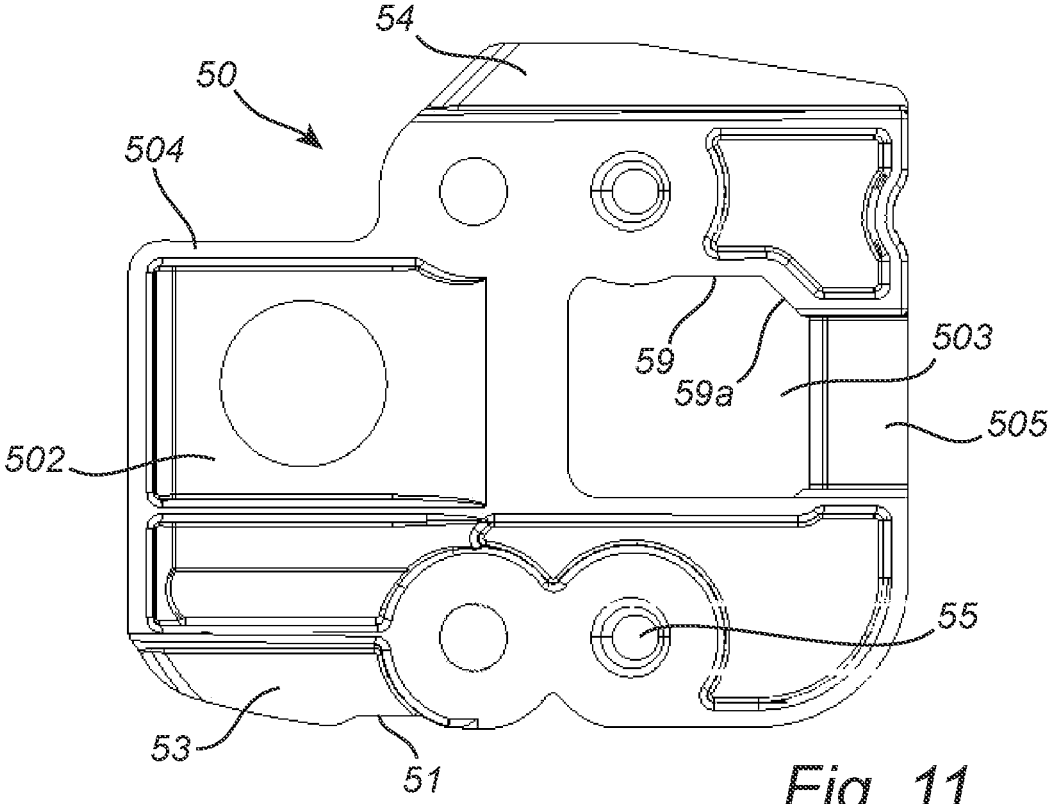
Figure 12:
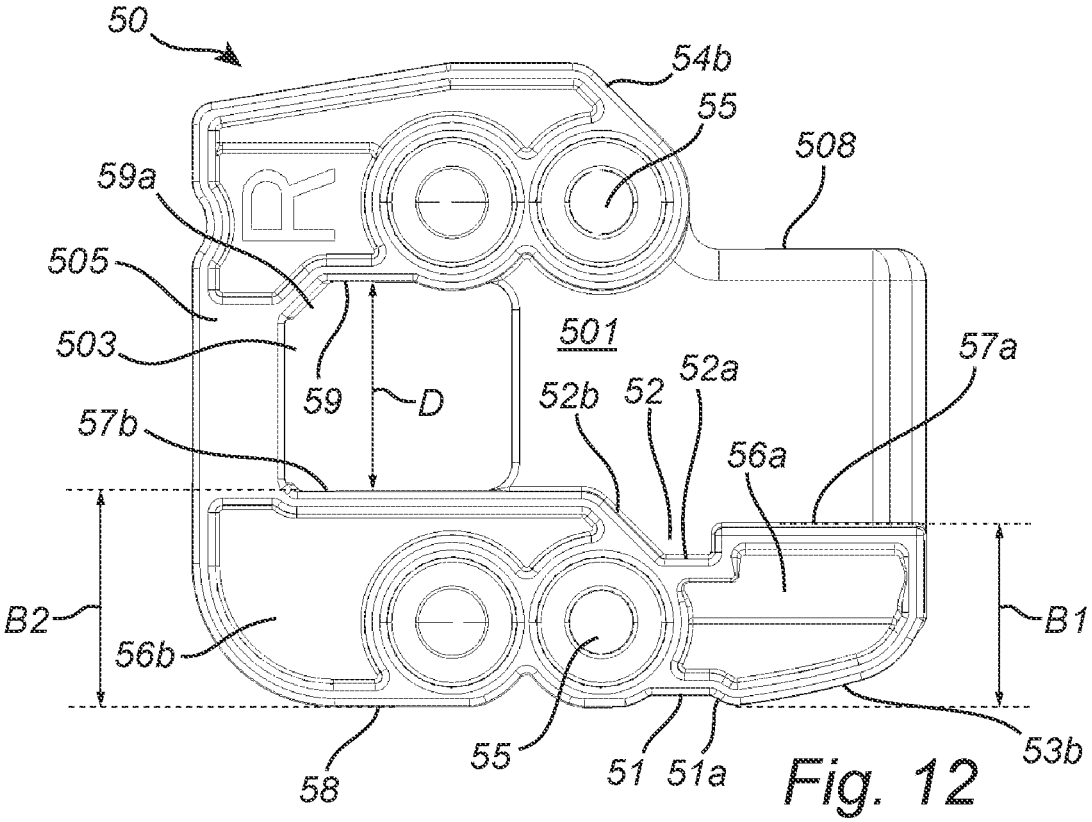
Figure 13:
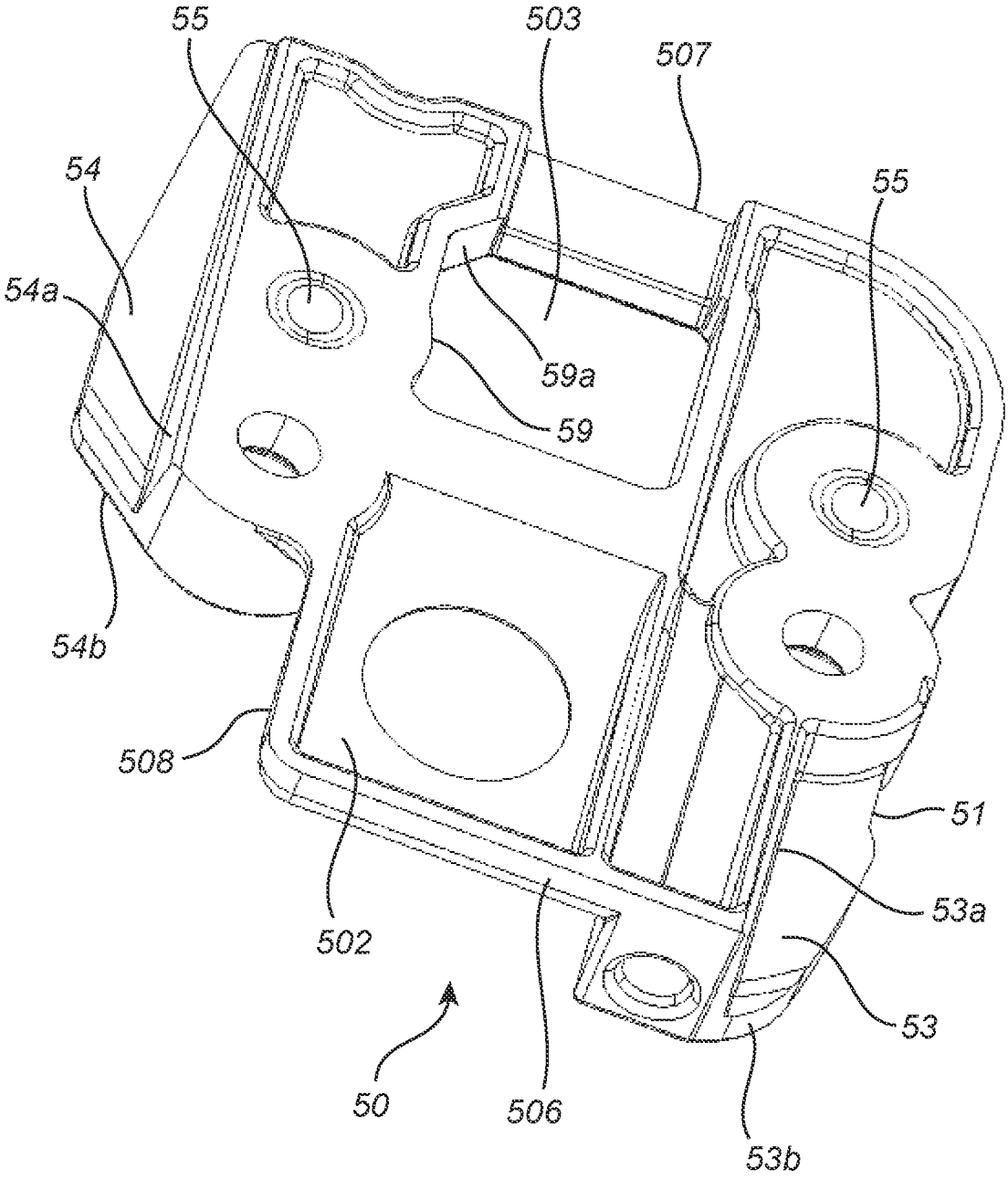
FIG. 13 is a perspective view of the mounting bracket shown in FIGS. 11 and 12.
Figure 14:
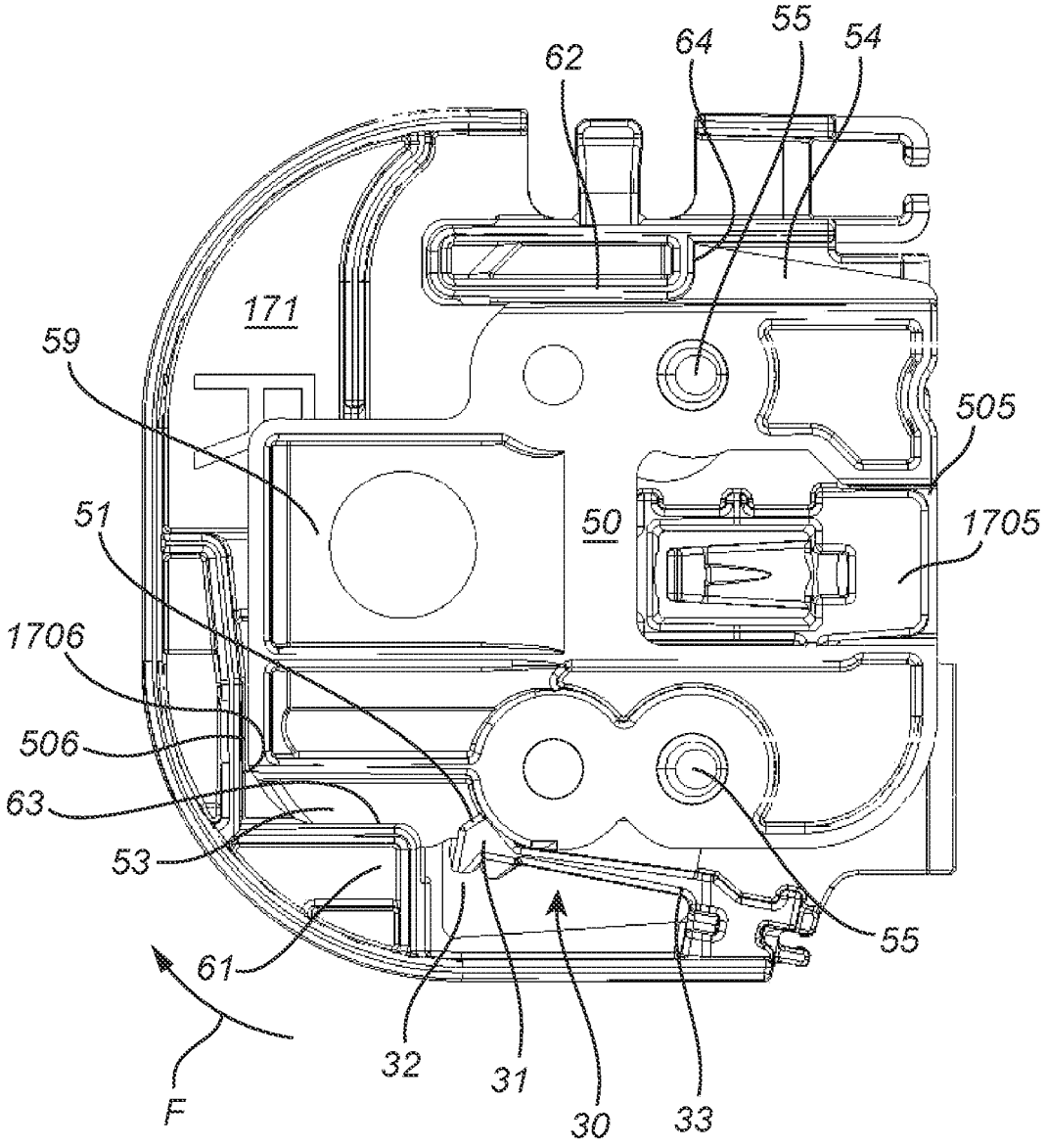
FIG. 14 is an end view of the end piece according to FIG. 9 and the mounting bracket according to FIGS. 11, 12 and 13 in an assembled state.

Referring to FIGS. 8 to 15, embodiments of a screening arrangement comprising a screening device, for instance of the kind mentioned in the above, and supporting means comprising a set of two end pieces and a set of two mounting brackets will be described in some detail. It is noted that the second end section 17 of the mounting bracket 50 and of the connection between the end piece 171 and the mounting bracket 50 will be described in further detail. FIGS. 9 and 10 show different views of the end piece 171 of the second end section 17, FIGS. 11, 12 and 13 show different views of the mounting bracket 50 and FIG. 14 illustrates the connection between the end piece 171 and the mounting bracket 50. Finally, FIGS. 15A to 15E show alternative embodiments of the screening arrangement supporting means.

In general, the screening arrangement will be described starting from a supply condition and is configured to be installed in the window frame to attain a mounted condition. As is known as such, the screening arrangement according to the invention is adapted to be mounted in a window frame 2 of a window 1 such as the one represented by the frame 2 shown in FIG. 1. The window frame may be an openable sash encasing a pane and adapted to be mounted in a stationary frame 2 to be installed in an inclined roof surface. It is noted that the terms "sash" or "frame" are to be understood as incorporating any substantially rectangular structure positioned in any opening in a building, whether in a wall or the roof, and surrounding an aperture to be screened. The window frame needs not be composed of separate frame members but may be a coherent frame. Notwithstanding, the portions of the window frame are referred to as "top member" denoted by reference numeral 4 in FIG. 1, "side members" 6, 7 shown in FIG. 1, and "bottom member" in order to facilitate reading.

It is noted that the first end section 16 and the second end section 17 are of analogous or even identical construction, although preferably mirror-images of each other. The below description therefore also applies to the first end section 16, to the construction of the end piece 161 of the first end section 16 and to the connection between the end piece 161 and a mounting bracket 50.

Terms such as "left-hand" and "right-hand" refer to the orientation shown in the drawings and/or in the mounted condition, and are utilized for reasons of convenience only. Similarly, the terms "front" and "back" are utilized to denote the sides of the screening arrangement, "front" being the side intended to face inwards into the interior of a building, and "back" the outwards facing side. The terms "upper" and "lower" refer to the orientation of the screening arrangement installed in a frame, where "upper" refers to general direction towards the top member of the frame and "lower" refers to the direction towards the bottom member of the frame. Other orientations of the screening arrangement in the window are however conceivable.

Referring to the orthogonal coordinate indication of FIG. 9, the frame members of the frame 2 includes top and bottom members 5, 4 as well as side members 6, 7. The frame 2 defines a width direction Y parallel to a longitudinal direction of the top and bottom members, a height direction Z parallel to a longitudinal direction of the side members, and a depth direction X perpendicular to the width and height directions.

Thus, in the mounted condition shown in particular in FIG. 1, the screening device 12 is mounted on the frame 2, with the length dimension of its top element 13 extending substantially in the width direction Y of the frame.

With particular reference to FIGS. 9 and 10, each end piece 171 provided on the top element 13 of the screening device 12 has a generally plane body portion 1710 extending substantially in a plane defined by a length dimension of the end piece 171 parallel to the depth direction X and a height dimension parallel to the height direction Z, perpendicular to a thickness dimension parallel to the width direction Y. Furthermore, the body portion 1710 is surrounded by a periphery, here in the form of a peripheral edge 1709 protruding from the body portion 1710. Finally, each end piece 171 is provided with at least one flange extending in the length dimension of the end piece 171 as will be described in further detail below.

Referring now also to FIGS. 11 to 13, each mounting bracket 50 has a thickness dimension, a height dimension, and a length dimension, and configured to be fastened to opposing side frame members 6, 7 such that the thickness dimension is parallel to the width direction Y, the height dimension is parallel to the height direction Z, and the length dimension is parallel to the depth direction X. Furthermore, each mounting bracket has a substantially plane body portion 501 extending substantially in a plane defined by the height and length dimensions, and at least one ledge, here represented by a first ledge section, referred to in the following as first lower ledge section 57*a*, extending in the length dimension of the mounting bracket 50. The form and shape of other ledges in the first embodiment will be described in further detail below.

As in the prior art screening arrangements of this kind, the screening device 12 is, during mounting from the supply condition to the mounted condition, configured to be connected with the set of mounting brackets 50 by moving the screening device with its set of end pieces 161, 171 substantially in the depth direction X, here represented by a lower flange 1720 of the respective end piece 171 of the screening device being adapted to ride on the at least one ledge during the mounting.

To keep the screening device 12 in safe holding on the mounting brackets 50 in the position of use, locking means are provided on the end pieces 171 and the mounting brackets 50 for providing engagement, between these, said locking means including sets of mutually cooperating female and male locking means on the respective mounting bracket and the end piece, or vice versa, including at least one set of locking means including a tab 40 on the end piece 171 and a notch 52 on the mounting bracket 50 which are engaged in the mounted condition of the screening arrangement to substantially lock the screening device 12 in the depth direction X. The engagement is shown i.a. in FIG. 14.

It is a central feature of the present invention that a resilient tab 30 is provided at the periphery of the end piece 171 and is biased in the height direction and acts on the end piece 171 such that the tab 40 is forced into the notch 52 in the mounted condition of the screening arrangement.

In this way, the cooperation between the tab 40 and notch 52 on one hand and the resilient tab 30 on the other acts to provide a snap lock which is engaged in the mounted condition.

While a safe locking of the tab 40 in the notch 52 in the mounted condition is achieved, the mounting bracket 50 and the end piece 171 are also configured to allow the end piece 171 to be positioned in a removal position relative to the mounting bracket 50. This is carried out by moving the top element 13 of the screening device 12 in the height direction Z, thereby pushing the resilient tab 30 against its bias. Once the tab 40 has been substantially withdrawn from the notch 52, the tab 40 is subsequently allowed to be disengaged from the notch 52 by pulling the top element 13 of the screening device 12 substantially in the opposite of the mounting direction, thereby dismounting the screening device 12. Until the user actively pulls the top element of the screening device in the dismounting direction, the snap lock is engaged.

In the embodiment shown, the resilient tab 30 is provided on the side of the peripheral edge 1709 facing the body portion 1710 and is biased upwards in the height direction.

Furthermore, the tab 40 faces the resilient tab 30 in the mounted condition and the resilient tab 30 defines a height level in its relaxed condition. The tab 40 has a guiding surface 41 located at a distance A from the resilient tab 30 in its relaxed condition and an abutment surface 42 to interact with the notch 52 of the mounting bracket 50.

In the embodiment shown, the mounting bracket 50 includes first ledge section 57*a* protruding from the plane body portion 501, located at a first distance B1 from an edge, here the bottom edge 58 of the mounting bracket 50. The first distance B1 is slightly smaller than the distance A between the guiding surface 41 of the tab 40 and the resilient tab 30 of the end piece 171 in its relaxed condition, such that the set of locking means is able to be engaged in the mounted condition and be disengaged when the end piece 171 is positioned in the removal position. The term "slightly smaller" is to be interpreted as encompassing such distances as are easily discernible to the person skilled in the art in order to ensure proper functioning of the lock in view of the dimensions of the screening arrangement, in particular of the mounting brackets and end pieces. Depending on the dimensions of the parts of the mounting bracket 50 and the end piece 171, the resilient tab 30 may for instance have a travel of 2-10 mm between its relaxed condition and its completely deformed condition in which it has been compressed or flexed against its bias. The choice of a suitable magnitude of the difference in distances between A and B in order to fulfil the slightly smaller requirement lies in the same magnitude.

Here, the tab 40 is provided with an inclined surface 43 adjacent the guiding surface 41, on the opposite side relative to the abutment surface 42, the abutment surface extending preferably perpendicularly to the guiding surface 41. While the abutment surface 43 is substantially straight, i.e. substantially perpendicular to the guiding surface 41 to ensure a safe holding in the notch 52, the inclined surface 43 facilitates the mounting.

Correspondingly, the notch 52 is in the embodiment shown provided with a straight portion 52*a* facing the abutment surface 43 in the mounted condition and with an inclined portion 52*b* at the opposite side of the notch 52.

Furthermore, the resilient tab 30 provided at the lower periphery of the end piece 171 and biased in the height direction Z is here configured to interact with a second notch 51 on the mounting bracket 50.

Here, the mounting bracket 50 comprises a first guiding section 56*a* and the ledge of the mounting bracket 50 includes a first lower ledge section 57*a* protruding from the plane body portion 501 in the first guiding section 56*a*, the first lower ledge section 57*a* being located at a first distance B1 from a bottom edge 58 of the mounting bracket, said first distance B1 corresponding substantially to but being slightly smaller than the distance A between the guiding surface 41 and the upper side 61*a* of the lower protrusion 61 of the end piece 171.

In order to facilitate the disengagement, the notch 51 is in the embodiment shown provided with an inclined portion 51*a*.

In the embodiment shown, the resilient tab 30 includes a nose section 31 configured to contact the notch 51, a hook section 32 opposing the nose section 31, an attachment section 33 near a base section 36 at a peripheral edge 1709, a middle section 34 between the attachment section 33 and the nose and hook sections 31, 32, and a spring element 35 lodged in the base section 36. In order to ease the mounting further, the resilient tab 30 is located adjacent a bottom guiding flange section 37 as shown.

The resilient tab 30 may in principle have any position along the periphery of the end piece 171 but is here provided near a lower end of the end piece 171. The end piece 171 is provided with a lower protrusion 61 having an upper side 61*a* extending substantially at the same height level as the resilient tab 30 in its relaxed condition, and furthermore with a tab 40 having a guiding surface 41 located at a distance A from the upper side 61*a* of the lower protrusion 61, and having an abutment surface 42 to interact with a notch 52 of the mounting bracket 50 to form a second set of locking means, the second set of locking means also being able to be disengaged when the end piece 171 is positioned in the removal position at an angle relative to the mounting bracket 50 when the top element 13 of the screening device 12 has been rotated in the rotational direction F about its length dimension in the mounted condition, thereby allowing dismounting of the screening device 12. The tab 40 is here shown as a fixed element, but may also be formed as a resilient part, having elastic or springy properties.

In the presently preferred embodiment shown and described, the tab 40 on the end piece 171 of the screening device 12 extends substantially downwards in the height direction Z in the mounted condition and the notch 52 on the mounting bracket 50 faces substantially upwards in the mounted condition. By this configuration it is achieved that in a window mounted in an inclined roof surface, at least a force component is acting to retain the tab 40 in the notch 52 as a result of gravity.

Furthermore, in the embodiment shown, the mounting bracket 50 comprises a second guiding section 56*b* and wherein the at least one ledge of the mounting bracket 50 includes a second ledge section, referred to in the following as second lower ledge section 57*b* protruding from the plane body portion 501 in the second guiding section 56*b*, the second lower ledge section 57*b* being located at a second distance B2 from the bottom edge 58 of the mounting bracket 50, the second distance B2 being larger than the first distance B1. The difference in height may be some millimetres, depending on other dimensions of the mounting bracket.

Here, the notch 52 is provided between the first and second lower ledge sections 57*a*, 57*b*. In the mounting process, tab 40 may thus initially rest on the first lower ledge section 57*a* and then ride on this ledge until it so to speak falls into the notch 52. As mentioned in the above, safe holding of the tab 40 in the notch 52 is ensured by the contact between the abutment portion 42 and the straight portion 52*a* near the first lower ledge section 57*a*. Easy installation ensured by an inclined portion 52*b* near the second lower ledge section 57*b*.

In the mounting bracket 50 of the first embodiment, the first guiding section 56*a* comprises a lower guiding flange 53 extending substantially in parallel with the body portion 501 and having a reduced thickness relative to the remaining portion of the first guiding section 56*a* including the first lower ledge section 57*a*.

Furthermore, the lower protrusion 61 is located at a distance from the body portion 1710 of the end piece 171 in the thickness dimension in parallel to the width direction Y to form an undercut 63.

The lower guiding flange 53 is adapted to slide into the undercut 63 behind the lower protrusion 61 and be retained in the thickness dimension in parallel with the width direction Y in the mounted condition, such that the lower guiding flange 53 and the undercut 63 form a first set of retaining means of the screening arrangement in the width direction Y.

Also in the embodiment shown, the first guiding section 56*a* is provided 15 with a lower guiding flange ledge 53*a* at the lower guiding flange 53, located at such a distance from the lower edge 58 of the mounting bracket 50 that it allows the end piece 171 to be positioned in its removal position. Ease of installation is ensured in that the lower guiding flange 53 is provided with a lower rounded guiding surface 53*b*.

It is a further characteristic of the first embodiment that the end piece 171 is provided with a central guiding structure protruding from the body portion 1710 and the at least one flange of the end piece 171 includes a lower flange 1720 at one side and an upper flange 1719 at the opposite side at a distance E from the lower flange 1720.

Additionally, the end piece 171 comprises an upper ledge 59 at a distance D from the second lower ledge section 57*b*.

In order to provide both smooth installation and make it possible for the end piece to obtain its removal position, the distance D between the upper ledge 59 and the second lower edge section 57*b* of the end piece 171 exceeds the distance E between the upper and lower flanges 1719, 1720 of the mounting bracket 50. Furthermore, in the embodiment shown, the upper ledge 59, and/or conceivably also of the second ledge section 57*b*, of the mounting bracket 50 is provided with a shoulder portion 59*a* to define a clearance relative to the upper and/or lower flanges 1719, 1720 of the end piece 171 in the range of 0.1 to 3 mm, preferably 0.2 to 2 mm. In this case, the end piece 171 is placed in a removal position at an angle relative to the mounting bracket 50 by rotating the top element 13 of the screening device 12 in a rotational direction F about its length dimension in the mounted condition, thereby pushing the resilient tab 30 against its bias and allowing the tab 40 to be withdrawn from notch 52 and the resilient tab 30 to be disengaged from the notch 51 to allow dismounting of the screening device 12.

A particularly stable installation and engagement is obtained in that the end piece 171 is provided with an additional protrusion 62 provided at the opposite peripheral part of the end piece 171 relative to the resilient tab 30, with a side 62*a* facing the resilient tab 30 and having an extension in the depth direction X substantially corresponding to the length of the resilient tab 30.

As shown, the mounting bracket 50 is provided with an upper guiding flange ledge 54*a*. In combination with the additional protrusion 62 positioned at an upper peripheral part of the end piece 171 and its side 62*a* facing the resilient tab 30, a reliable engagement during mounting is obtained in that the side 62*a* acts as an additional flange to ride on the guiding flange ledge 54*a* during mounting.

Also in order to increase the retention in the width direction, the additional protrusion is formed as an upper protrusion 62 located at a distance from the body portion 1710 of the end piece 171 in the thickness dimension in parallel to the width direction Y to form an undercut 64. As the mounting bracket 50 is provided with an upper guiding flange 54 adjoining the upper guiding flange ledge 54*a*, the upper guiding flange 54 is adapted to slide into the undercut 64 behind the upper protrusion 52 and be retained in the thickness dimension in parallel with the width direction Y in the mounted condition, such that the upper guiding flange 54 and the undercut 64 form a second set of retaining means of the screening arrangement in the width direction Y. The upper guiding flange 54 is here provided with an inclined guiding surface 54*b*.

Additional engagement is obtained by the further feature that the central guiding structure is provided with a tab section 1705 extending between the upper and lower flanges 1719, 1720 and the mounting bracket 50 is provided with a bridge section 505, and wherein the tab section 1705 is accommodated in the bridge section 505 in the mounted condition of the screening arrangement.

The fundamental steps in installing and uninstalling a screening arrangement in a window are thus the following:

aligning the end pieces 171 of the screening device 12 with the respective mounting bracket 50, moving the screening device 12 with the top element 13 in the depth direction X, allowing the resilient tabs 30 of the end pieces 171 to move against their bias to engage the tab 40 of the respective end piece with the notch 52 of the respective mounting bracket 50 to attain the mounted condition, moving the top element 13 of the screening device 12 in the height direction Z to attain the removal position, and moving the top element 13 of the screening device 12 substantially oppositely to the mounting direction.

FIGS. 15A to 15E all show schematic variants of the fundamental principles underlying the invention, namely that the locking means include a tab 40 to cooperate with a notch 52, and in which a resilient tab 30 provided at the periphery of the end piece 171 and biased in the height direction.

Figure 15A:
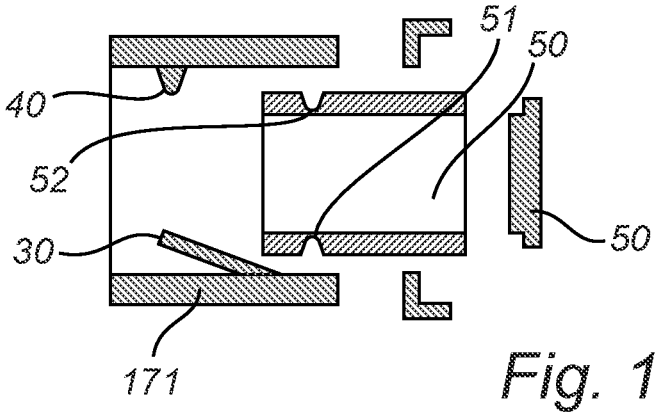
FIGS. 15A-E are end views of five different embodiments of an end piece and a mounting bracket according to the invention, where a cross-sectional view of the respective mounting bracket is also shown on FIGS. 15A, 15D and 15E.

In the embodiment of FIG. 15A, the main difference from the first embodiment described in the above is that there is no central guiding structure. The tab 40 is positioned at the upper periphery of the end piece 171 to interact with the notch 52 formed in the upper ledge of the mounting bracket. The resilient tab 30 is positioned at the lower periphery to interact with notch 51 on the mounting bracket 50, namely in the bottom edge of the mounting bracket. As in the first embodiment, the mounting bracket 50 and the end piece 171 are so configured to allow the end piece to be positioned in a removal position in which the tab 40 is lifted up of the notch 52, against the bias of the resilient tab 30, following which the end piece 171 may be moved oppositely to the mounting direction. Undercuts (not shown in detail) may as in the above-mentioned first embodiment be provided to ensure proper retention also in the width direction.

Figure 15B:
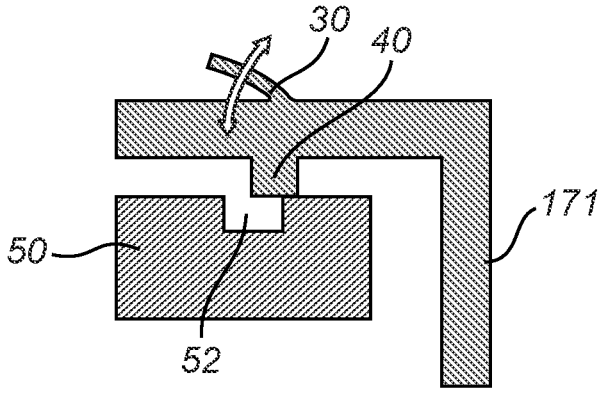

In the embodiment of FIG. 15B, the resilient tab 30 is also positioned at the periphery of the end piece 171, however on the side intended to face the top frame member. Here, the resilient tab 30 is dependent on pressing against the top frame member in order to exert its bias to ensure that the tab 40 snaps into the notch 52.

Figure 15C:
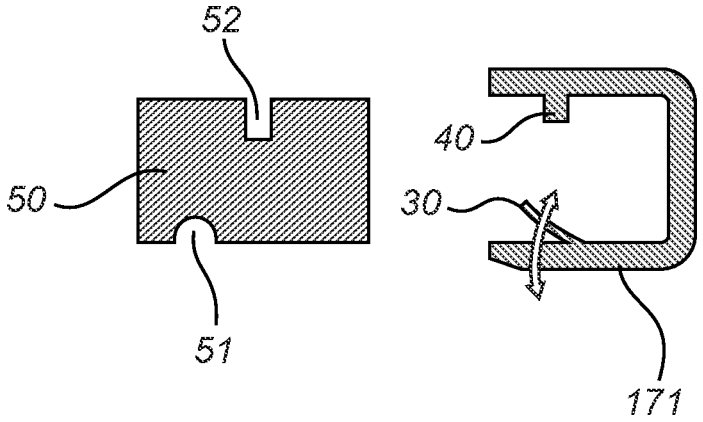

The embodiment of FIG. 15C is basically a simplified version of the embodiment of FIG. 15A.

Figure 15D:
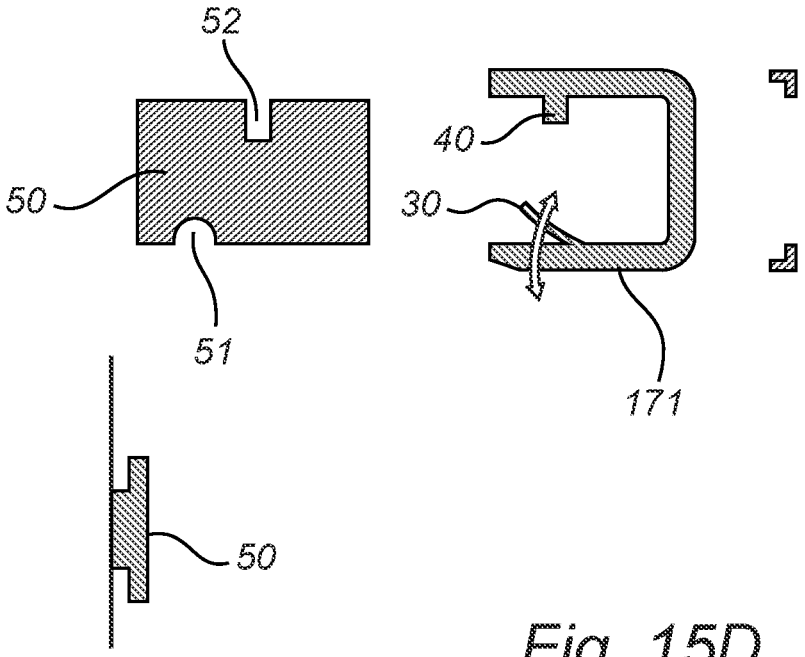

Correspondingly, the embodiment of FIG. 15D is a further development of the embodiment of FIG. 15A in that a set of undercuts provide for additional retention of the top element of the screening device also in the width direction.

Figure 15E:
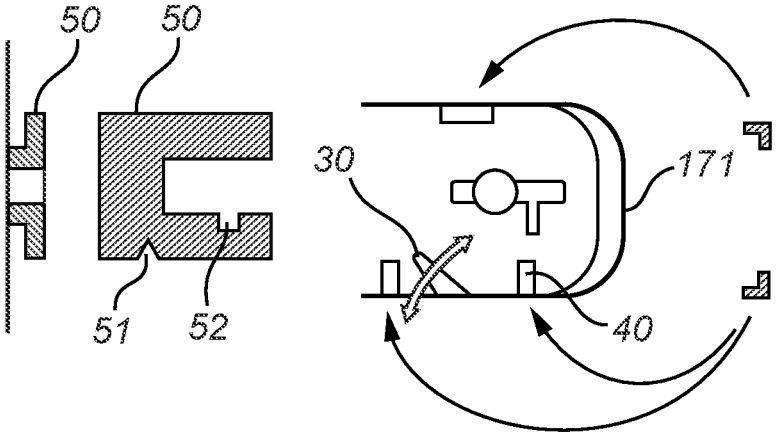

Finally, FIG. 15E shows a schematic view of an embodiment in which the engagement between the tab 40 and the notch 52 on one hand and the resilient tab 30 and the second notch 51 resembles that of the first embodiment shown and described in the above. The mounting bracket 50 is here provided with additional undercuts to cooperate with guiding flanges on the end piece.

The person skilled in the art realises that the present invention by no means is limited to the preferred embodiments described above. On the contrary, many modifications and variations are possible within the scope of the appended claims.

List of reference numerals

| | |
|---|---|
| 1 | window |
| 2 | frame |
| 3 | sash (not shown) |
| 4 | top frame member |
| 5 | bottom frame member |
| 6, | side frame members |
| 7 | |
| 8 | top sash member (not shown) |
| 9 | bottom sash member (not shown) |
| 10, | side sash members (not shown) |
| 11 | |
| 12 | screening device |
| 13 | top element |
| 14 | screening body |
| 15 | roller tube |
| 16, | end section |
| 17 | |
| | 161, 171 end piee |
| | 1611 pin |
| | 1612 snap locking element |
| | 1631 opening |
| | 162, 172 inner piece |
| | 163, 173 rod element |
| | 164, 174 spring |
| | 165, 175 rotating element/ring |
| | 166, 176 rotating holder |
| | 167, 177 rotating holder |
| | 168, 178 seat/bearing |

-continued

| List of reference numerals | |
|---|---|
| 18 | motor |
| | 181 tachometer |
| | 182 printed circuit board |
| | 183 planetary gear |
| | 184 rotatable cap |
| 19 | bottom bar |
| 20 | winding wheel |
| 21 | wire (metal) |
| 22 | return pulley |
| 23 | end stop |
| | Elements of end piece 171 |
| 1705 | tab section |
| 1706 | stop surface |
| 1709 | peripheral edge |
| 1710 | body portion (generally plane, see FIG. 10) |
| 1711 | pin |
| 1712 | snap locking element |
| | 17121 guiding structure |
| | 17122 recess |
| 1713 | recess |
| 1714 | end stop |
| 1715 | flexible arm |
| 1716 | stop surface |
| 1717 | hole for rod element |
| 1718 | guiding opening |
| 1719 | flange (upper) |
| 1720 | flange (lower) |
| 1721 | pin |
| 1722 | snap locking element (pin) |
| | 17221 guiding structure |
| | 17222 recess |
| 1723 | recess |
| 1724 | end stop |
| 1725 | flexible arm |
| 1726 | stop surface |
| 1727 | hole for rod element |
| 1728 | guiding opening |
| 1729 | flange |
| 1731, 1732 | opening |
| 1733 | lug |
| 1734 | cross section |
| 30 | resilient tab |
| | 31 nose section |
| | 32 hook section |
| | 33 attachment section |
| | 34 middle section |
| | 35 spring element |
| | 36 base section |
| | 37 bottom guiding flange section |
| 40 | tab (fixed) |
| | 41 guiding surface |
| | 42 abutment surface |
| | 43 inclined surface |
| 60 | top flange |
| 61 | lower protrusion |
| | 61a upper side of lower protrusion |
| 62 | additional (upper) protrusion |
| | 62a (under) side of additional (upper) protrusion |
| 63 | undercut |
| 64 | undercut |
| 50 | mounting bracket |
| | 501 body portion |
| | 502 body portion opposite side |
| | 503 aperture |
| | 504 rib sections |
| | 505 bridge section |
| | 506 front end edge |
| | 507 back end edge |
| | 508 middle edge |
| | 51 second notch, matching tab 40 |
| | 51a inclined portion of notch 51 |
| | 52 notch, matching resilient tab 30 |
| | 52a straight portion of notch 52 |
| | 52b inclined portion of notch 52 |
| | 53 lower guiding flange |

-continued

| List of reference numerals | |
|---|---|
| | 53a lower guiding flange ledge |
| | 53b lower rounded guiding surface |
| | 54 (upper) guiding flange |
| | 54a (upper) guiding flange ledge |
| | 54b (upper) inclined guiding surface |
| | 55 mounting hole |
| | 56a first guiding section |
| | 56b second guiding section |
| | 57a first lower ledge section |
| | 57b second lower ledge section |
| | 58 lower edge of mounting bracket |
| | 59 upper ledge |
| | 59a shoulder portion of upper ledge |
| A | distance between element 30/61 and 41 |
| B1 | first distance between element 57a and 58 |
| B2 | second distance between 57b and 58 |
| C | arrow |
| D | distance between 57b and 59 |
| E | distance between 1719 and 1720 |
| F | arrow (indicating slight clock-wise rotation) |
| L | line defined by part of pin extending through rod element |
| X | first direction/depth direction |
| Y | second direction/width direction |
| Z | third direction/height direction |

The invention claimed is:

1. A screening arrangement for a window having at least one frame including a top member and a bottom member and opposing side members, said at least one frame defining a width direction extending parallel to a longitudinal direction of the top member and the bottom member, a height direction extending parallel to a longitudinal direction of the opposing side members, and a depth direction extending perpendicular to the width and height directions, comprising:

a screening device with a top element having a length dimension and adapted for mounting on the at least one frame of the window to extend substantially in the width direction of the at least one frame in a mounted condition, said screening device having a set of two end pieces provided on the top element of the screening device, each end piece of the set of two end pieces having a body portion surrounded by a periphery, said body portion extending substantially in a plane defined by a length dimension of a corresponding end piece of said end pieces, and a set of two mounting brackets, each mounting bracket of the set of two mounting brackets having a thickness dimension, a height dimension, and a length dimension, each mounting bracket of the set of two mounting brackets being configured to be fastened to one of the opposing side members, each mounting bracket of the set of two mounting brackets having a body portion extending substantially in a plane defined by the height and length dimensions of a corresponding mounting bracket of said mounting brackets, the screening device is configured to be connected to the set of two mounting brackets by moving the screening device with its set of two end pieces in a mounting direction substantially in the depth direction, and locking means being provided on each of the two end pieces and each of the two mounting brackets, said locking means being configured to provide engagement between the corresponding end piece and the corresponding mounting bracket when the screening arrangement is in a mounted condition to substantially lock the screening device relative to the two mounting brackets in the depth direction, said locking means including a first set of locking means including a tab having a height dimension in the height direction provided on at least one end piece of the set of two end pieces and configured to extend into and engage a notch of the corresponding mounting bracket to lock the screening arrangement in the mounted condition, a resilient tab being provided at the periphery of the at least one end piece and biased in the height direction to prevent the tab from being disengaged from the notch in the mounted condition, and the corresponding mounting bracket and the at least one end piece are configured to allow the at least one end piece to be positioned in a removal position relative to the corresponding mounting bracket by moving the top element of the screening device in the height direction, thereby pushing the resilient tab against its bias and subsequently allowing the tab to be disengaged from the notch by pulling the top element of the screening device substantially in a direction opposite of the mounting direction, thereby dismounting the screening device.

2. A screening arrangement according to claim 1, wherein the tab faces the resilient tab in the mounted condition and the resilient tab defines a height level in its relaxed condition, and the tab has a guiding surface located at a distance from the resilient tab in its relaxed condition and an abutment surface to interact with and engage the notch of the mounting bracket, and wherein the corresponding mounting bracket includes a first ledge section protruding from the body portion and located at a first distance from an edge of the corresponding mounting bracket, said first distance being slightly smaller than the distance between the guiding surface of the tab and the resilient tab of the at least one end piece in its relaxed condition, such that the first set of locking means is able to be engaged in the mounted condition and be disengaged when the at least one end piece is positioned in the removal position.

3. A screening arrangement according to claim 1, wherein said tab is fixed or resilient.

4. A screening arrangement according to claim 1, wherein the tab extends substantially downwards in the height direction into the notch in the mounted condition and the notch faces substantially upwards in the mounted condition, thereby providing at least a force component acting to retain the tab in the notch as a result of gravity.

5. A screening arrangement according to claim 1, wherein the resilient tab is provided at the periphery of the at least one end piece and biased in the height direction to engage a second notch on the corresponding mounting bracket to provide a second set of locking means.

6. A screening arrangement according to claim 1, wherein the at least one end piece is provided with a central guiding structure protruding from the body portion and including a lower flange at one side and an upper flange at an opposite side at a distance from the lower flange.

7. A screening arrangement according to claim 1, wherein the at least one end piece is provided with an additional protrusion provided at an opposite peripheral part of the at least one end piece relative to the resilient tab, with a side facing the resilient tab and having an extension in the depth direction substantially corresponding to a length of the resilient tab.

8. A screening arrangement according to claim 1, wherein the mounting bracket is provided with an upper guiding flange ledge.

9. A screening arrangement according to claim 2, wherein the tab is provided with an inclined surface adjacent the guiding surface, on a side opposite to the abutment surface, the abutment surface extending perpendicularly to the guiding surface.

10. A screening arrangement according to claim 2, wherein the notch is provided with a straight portion facing the abutment surface in the mounted condition and an inclined portion forming a side of the notch.

11. A screening arrangement according to claim 2, wherein the corresponding mounting bracket comprises a first guiding section in which the first ledge section is protruding from the body portion, and wherein the at least one end piece has a lower protrusion with an upper side located substantially at the same height level as the resilient tab in its relaxed condition.

12. A screening arrangement according to claim 5, wherein the second notch is provided with an inclined portion.

13. A screening arrangement according to claim 5, wherein the resilient tab includes a nose section configured to contact the second notch, a hook section opposing the nose section, an attachment section near a base section at a peripheral edge of the at least one end piece, a middle section between the attachment section and the nose and hook sections, and a spring element lodged in the base section, and a bottom guiding flange section.

14. A screening arrangement according to claim 6, wherein the central guiding structure is provided with a tab section extending between the upper and lower flanges and the corresponding mounting bracket is provided with a bridge section, and wherein the tab section is accommodated in the bridge section in the mounted condition of the screening arrangement.

15. A screening arrangement according to claim 7, wherein the additional protrusion is formed as an upper protrusion located at a distance from the body portion of the at least one end piece in the thickness dimension of the at least one end piece in parallel to the width direction to form an undercut.

16. A screening arrangement according to claim 7, wherein the additional protrusion is positioned at an upper peripheral part of the at least one end piece and its side facing the resilient tab acts as an additional flange to ride on the guiding flange ledge during mounting.

17. A screening arrangement according to claim 8, wherein the corresponding mounting bracket is provided with an upper guiding flange adjoining the upper guiding flange ledge.

18. A screening arrangement according to claim 11, wherein the corresponding mounting bracket comprises a second guiding section in which a second ledge section is protruding from the body portion, the second ledge section being located at a second distance from the bottom edge of the corresponding mounting bracket, the second distance being larger than the first distance between the first ledge section and the bottom edge.

19. A screening arrangement according to claim 11, wherein the first guiding section comprises a lower guiding flange extending substantially in parallel with the body portion and having a reduced thickness relative to a remaining portion of the first guiding section including the first ledge section.

20. A screening arrangement according to claim 11, wherein the lower protrusion is located at a distance from the body portion of the at least one end piece in the thickness dimension in parallel to the width direction to form an undercut.

21. A screening arrangement according to claim 11, wherein the first guiding section is provided with a lower guiding flange ledge at the lower guiding flange, located at such a distance from the lower edge of the corresponding mounting bracket that it allows the at least one end piece to be positioned in its removal position.

22. A screening arrangement according to claim 17, wherein the upper guiding flange is adapted to slide into an undercut behind the upper protrusion and be retained in the thickness dimension of the corresponding mounting bracket in parallel with the width direction in the mounted condition, such that the upper guiding flange and the undercut form a second set of retaining means of the screening arrangement in the width direction.

23. A screening arrangement according to claim 17, wherein the upper guiding flange is provided with an inclined guiding surface.

24. A screening arrangement according to claim 18, wherein the notch is provided between the first and second ledge sections.

25. A screening arrangement according to claim 18, wherein the corresponding mounting bracket comprises an upper ledge at a distance from the second ledge section.

26. A screening arrangement according to claim 19, wherein the lower guiding flange is provided with a lower rounded guiding surface.

27. A screening arrangement according to claim 20, wherein a lower guiding flange is adapted to slide into the undercut behind the lower protrusion and be retained in the thickness dimension in parallel with the width direction in the mounted condition, such that the lower guiding flange and the undercut form a first set of retaining means of the screening arrangement in the width direction.

28. A screening arrangement according to claim 25, wherein the distance between the upper ledge and the second ledge section of the corresponding mounting bracket exceeds a distance between the upper and lower flanges of the at least one end piece.

29. A screening arrangement according to claim 28, wherein the upper ledge and/or the second ledge section of the corresponding mounting bracket is provided with a shoulder portion to define a clearance relative to the upper and/or lower flanges of the at least one end piece in the range of 0.1 to 3 mm.

30. A screening arrangement according to claim 29, wherein the at least one end piece and the corresponding mounting bracket are configured such that rotational movement of the top element overcomes the bias of the resilient tab to allow the tab to move out of the notch to allow dismounting of the screening device.

31. A screening arrangement for a window having at least one frame including a top member and a bottom member and opposing side members, said at least one frame defining a width direction extending parallel to a longitudinal direction of the top member and the bottom member, a height direction extending parallel to a longitudinal direction of the opposing side members, and a depth direction extending perpendicular to the width and height directions, said screening arrangement comprising:

a screening device with a top element having a length dimension and adapted for mounting on the at least one frame to extend in the width direction of the at least one frame in a mounted condition, said screening device having a first end piece and a second end piece, the first end piece and the second end piece each having a body portion surrounded by a periphery, said body portion extending substantially in a plane defined by a length dimension of a corresponding end piece of said end pieces, and a first mounting bracket and a second mounting bracket, said first mounting bracket and said second mounting bracket each having a thickness dimension, a height dimension, and a length dimension and being configured to be fastened to one of the opposing side frame members, said first mounting bracket and said second mounting bracket each having a body portion extending substantially in a plane defined by the height and length dimensions of a corresponding mounting bracket of said mounting brackets, the screening device being configured to be connected to the first mounting bracket and the second mounting bracket by moving the screening device with the first end piece and the second end piece in a mounting direction in the depth direction where when in the mounted condition the first mounting bracket is connected to the first end piece and the second mounting bracket is connected to the second end piece, and a first set of locking members including a first tab having a height dimension in the height direction and a notch wherein said first tab is configured to extend into and engage said notch when said screening arrangement is in the mounted condition to lock the screening arrangement in the mounted condition, said first locking members further includes a second tab, said second tab being a resilient tab configured to be biased in the height direction to prevent the first tab from being disengaged from the notch in the mounted condition; and the first mounting bracket and the first end piece being configured to allow the first end piece to be positioned in a removal position relative to the first mounting bracket by moving the top element of the screening device in the height direction, thereby pushing the second tab against its bias and subsequently allowing the first tab to be removed and disengaged from the notch by pulling the top element of the screening device in a removal direction thereby dismounting the screening device, wherein the removal direction is different from the mounting direction.

* * * * *